US006966826B2

(12) United States Patent
Suzuki et al.

(10) Patent No.: US 6,966,826 B2
(45) Date of Patent: Nov. 22, 2005

(54) GRINDING WHEEL

(75) Inventors: Masaaki Suzuki, Tokyo (JP); Kazuma Sekiya, Tokyo (JP)

(73) Assignee: Disco Corporation, Tokyo (JP)

( * ) Notice: Subject to any disclaimer, the term of this patent is extended or adjusted under 35 U.S.C. 154(b) by 248 days.

(21) Appl. No.: 09/972,872

(22) Filed: Oct. 10, 2001

(65) Prior Publication Data

US 2003/0032382 A1 Feb. 13, 2003

(30) Foreign Application Priority Data

Jul. 4, 2001 (JP) ..... 2001-203115
Sep. 17, 2001 (JP) ..... 2001-281505

(51) Int. Cl.[7] ..... B24B 55/02
(52) U.S. Cl. ..... 451/450; 451/548
(58) Field of Search ..... 451/450, 548, 451/488, 53, 287, 289, 285, 550

(56) References Cited

U.S. PATENT DOCUMENTS 2,455,597 A * 12/1948 Metzger et al. ..... 451/548
2,840,960 A * 7/1958 Booth ..... 451/450
3,110,993 A * 11/1963 Grage ..... 451/450
4,791,760 A * 12/1988 Noll ..... 451/53
4,854,087 A 8/1989 Riha

FOREIGN PATENT DOCUMENTS

| | | | |
|---|---|---|---|
| CH | 321620 | * 6/1957 | ..... 451/450 |
| DE | 296 04 423 | 7/1996 | |
| EP | 0 505 615 | 9/1992 | |
| EP | 0 876 877 | 11/1998 | |
| FR | 1318959 | * 1/1963 | ..... 451/450 |
| GB | 1215064 | * 12/1970 | ..... 451/450 |
| JP | 40-5069338 | * 3/1993 | ..... 451/450 |

OTHER PUBLICATIONS

Derwent Abstract Accession No. E6848A/24, SU 566725 A (As UKR Hard Mater) dated Aug. 25, 1977.

* cited by examiner

*Primary Examiner*—Robert A. Rose
(74) *Attorney, Agent, or Firm*—Smith, Gambrell & Russell

(57) ABSTRACT

A grinding wheel comprises an annular base and a grinding stone means mounted on the under surface of the base. A coolant pool which is open inward in a radial direction is formed in the inner surface of the base.

19 Claims, 3 Drawing Sheets

GRINDING WHEEL

FIELD OF THE INVENTION

The present invention relates to a grinding wheel used suitably for grinding one side of a semiconductor wafer in particular but not limited thereto.

DESCRIPTION OF THE PRIOR ART

As well known to people of ordinary skill in the art, in the production of a semiconductor device, one-side grinding is carried out to grind one side of a semiconductor wafer to a predetermined thickness. A chuck table having a flat holding-surface and a grinder having a rotary shaft disposed opposite to the table are used for grinding. The semiconductor wafer is held on the chuck table in such a manner that one side to be ground is exposed (therefore, the other side is in close contact with the chuck table) and a grinding wheel is attached to the end of the rotary shaft. The grinding wheel comprises an annular base and a grinding stone means mounted on the under surface of the base. The grinding stone means is generally composed of a plurality of grinding stones which extend in an arc form in a circumferential direction and are spaced apart from one another in the circumferential direction. A plurality of coolant flow holes are formed in the base at predetermined intervals in the circumferential direction. The coolant flow holes extend penetratingly through the base from the top to the bottom, and their lower ends are located on the inner side in a radial direction of the grinding stone means mounted on the under surface of the base. The chuck table is turned at a relatively low speed (for example, 100 to 300 rpm), and the rotary shaft and the grinding wheel attached to the rotary shaft are rotated at a relatively high speed (for example, 4,000 to 5,000 rpm). The grinding stone means of the grinding wheel is pressed against one side of the semiconductor wafer and moved forward, whereby a grinding of one side of the semiconductor wafer is effected. During grinding, a coolant such as pure water is supplied into the coolant flow holes of the grinding wheel through a coolant flow passage formed in the rotary shaft to flow out from the coolant flow holes which are open to the under surface of the base.

From the experience of the inventor of the present invention, it has been found that in grinding using the conventional grinding wheel described above, the coolant supplied is not fully effectively used for cooling the grinding stone means of the grinding wheel and the to-be-ground surface of an object to be ground, i.e., a semiconductor wafer with the result that the grinding efficiency is not always satisfactorily high and the abrasion of the grinding stone means of the grinding wheel is relatively large.

SUMMARY OF THE INVENTION

It is a principal object of the present invention to make fully effective use of the coolant to be supplied to cool the grinding wheel and the to-be-ground object by improving the grinding wheel.

When the inventor of the present invention has studied the grinding using the conventional grinding wheel, it has been recognized that a considerable amount of the coolant flows outward in a radial direction without being fully utilized to cool the grinding stone means and the to-be-ground object because of a relatively high speed revolution of the grinding wheel. Based on the above recognition, it has been found that the above principal object can be attained by improving the shape of the base of the grinding wheel, more specifically, forming a coolant pool which is open inward in the radial direction in the inner surface (inner circumferential surface) of the base so that the coolant supplied to the base of the grinding wheel is temporarily prevented from flowing outward in the radial direction and then, caused to overflow toward the grinding stone means and the to-be-ground object.

In other words, according to the present invention, there is provided a grinding wheel comprising an annular base and a grinding stone means mounted on the under surface of the base, wherein a coolant pool which is open inward in a radial direction is formed in the inner surface of the base.

In a preferred embodiment of the present invention, the coolant pool continuously extends in a circumferential direction. The coolant pool is defined between an upper inclined surface which inclines downwardly outward in the radial direction and a projecting surface which extends substantially horizontally and outward in the radial direction below the upper inclined surface. A plurality of communication notches or communication holes which communicate with the coolant pool from the top surface of the base are formed at predetermined intervals in the circumferential direction. The base has a lower inclined surface which inclines downwardly outward in the radial direction below the projecting surface. Preferably, a plurality of coolant guide grooves which extend from the coolant pool to the grinding stone means are formed in the inner surface and the under surface of the base at predetermined intervals in the circumferential direction. Preferably, the coolant guide grooves extend from the coolant pool toward the grinding stone means and are inclined toward one side in the circumferential direction. In a preferred embodiment, the grinding stone means is composed of a plurality of grinding stones which extend in an arc form in the circumferential direction and are spaced apart from one another in the circumferential direction, and the coolant guide grooves are formed correspondingly to the grinding stones.

DETAILED DESCRIPTION OF THE PREFERRED EMBODIMENTS

Preferred embodiments of a grinding wheel constituted according to the present invention will be described in more detail with reference to the accompanying drawings.

Figure 1:
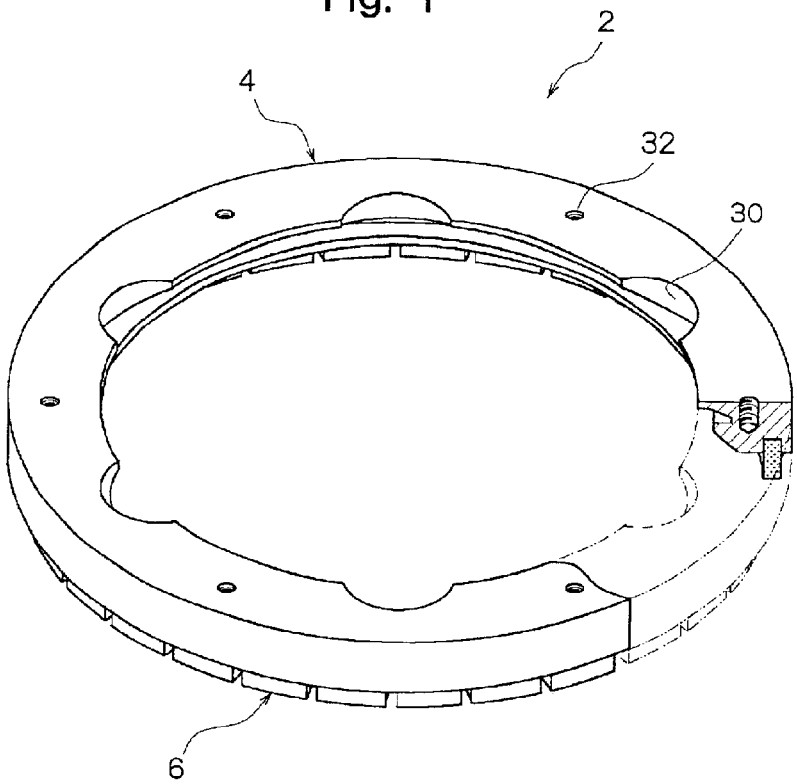
FIG. 1 is a partially cutaway perspective view of a preferred embodiment of a grinding wheel constituted according to the present invention.
Figure 2:
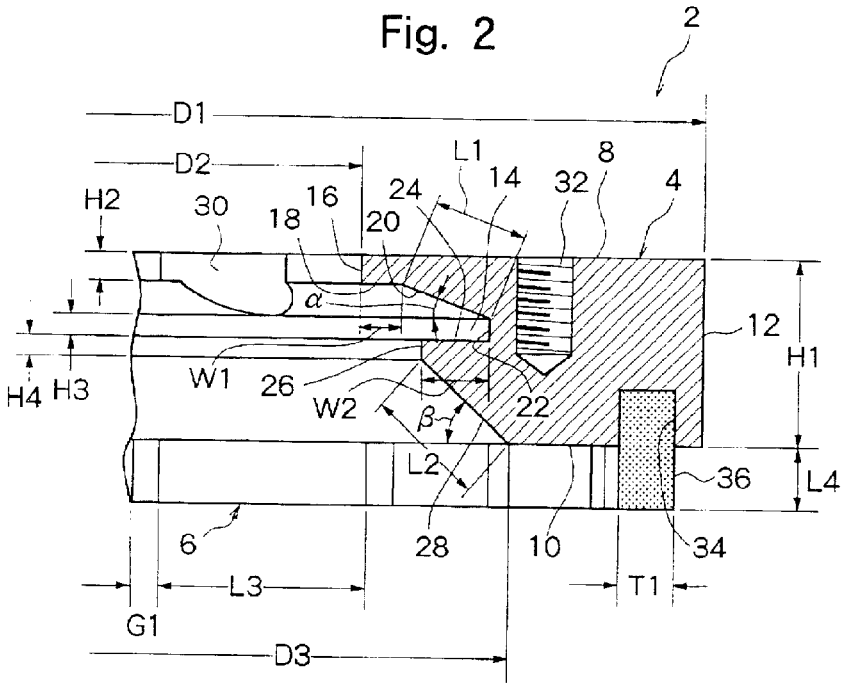
FIG. 2 is a partially enlarged sectional view of the grinding wheel shown in FIG. 1.

With reference to FIG. 1 and FIG. 2, the grinding wheel entirely denoted by numeral 2 comprises a base 4 and a grinding stone means 6. The base 4 which can be made from a suitable metal such as aluminum is ring-shaped as a whole and has an annular top surface 8 which is substantially horizontal, an annular under surface 10 which is substantially horizontal and a cylindrical outer surface 12 which is substantially vertical.

It is important that a coolant pool 14 which is open inward in a radial direction is formed in the inner surface of the base 4. In the illustrated embodiment, the inner surface of the base 4 includes an upper vertical surface 16 which extends substantially vertically downward, a retreating surface 18 which extends substantially horizontally from the lower end of the upper vertical surface 16 outward in the radial direction, an upper inclined surface 20 which extends inclinedly downwardly outward in the radial direction from the outer end in the radial direction of the retreating surface 18, an intermediate vertical surface 22 which extends substantially vertically downward from the lower end of the upper inclined surface 20, a projecting surface 24 which extends inward in the radial direction and substantially horizontally from the lower end of the intermediate vertical surface 22 and hence, below the upper inclined surface 20, a lower vertical surface 26 which extends substantially vertically downward from the inner end in the radial direction of the projecting surface 24, and a lower inclined surface 28 which extends inclinedly downwardly outward in the radial direction from the lower end of the lower vertical surface 26. A coolant pool 14 having a nearly right-angled triangular sectional form is defined between the upper inclined surface 20 and the projecting surface 24. Excluding portions where communication notches to be described later are formed, the above upper vertical surface 16, retreating surface 18, upper inclined surface 20, intermediate vertical surface 22, projecting surface 24, lower vertical surface 26 and lower inclined surface 28 are continuously formed in a circumferential direction, and the above coolant pool 14 is also continuously formed in the circumferential direction. The coolant pool 14 is not necessarily continuously formed in the circumferential direction. If desired, a plurality of coolant pools extending in the circumferential direction may be formed at predetermined intervals in the circumferential direction. The inclination angle a of the upper inclined surface 20 may be about 10 to 30°. The inclination angle β of the lower inclined surface 28 may be about 35 to 55°. If desired, the projecting surface 24 may be inclined downwardly inward in the radial direction at an angle of 20° or less.

As clearly understood with reference to FIG. 1, a plurality of communication notches 30 extending from the top surface 8 to the above retreating surface 18 of the inner surface are formed in the base 4 at predetermined intervals in the circumferential direction. More specifically, six notches are formed at equiangular intervals so that the top surface of the base 4 communicates with the above coolant pool 14 through the communication notches 30. Each of the communication notches 30 is substantially semicircular and open on the inner side in the radial direction. If desired, communication holes which have a suitable sectional form such as a circular form and are closed on the inner side in the radial direction may be formed in place of the communication notches 30. A plurality of blind screw holes 32 which extend substantially vertically downward from the top surface 8 are further formed in the base 4 at predetermined intervals in the circumferential direction. In the illustrated embodiment, 6 blind screw holes 32 are formed at equiangular intervals and located at intermediate positions between adjacent communication notches 30, viewed from the circumferential direction.

Keeping describing with reference to FIG. 1 and FIG. 2, the above grinding stone means 6 is mounted on the under surface 10 of the base 4. Stated more specifically, in the illustrated embodiment, an annular groove 34 extending continuously in the circumferential direction is formed in the under surface 10 of the base 4. The grinding stone means 6 is composed of a plurality (27 pieces in the illustrated embodiment) of grinding stones 36 which extend in an arc form in the circumferential direction and are spaced apart from one another in the circumferential direction, and a top portion of each grinding stone 36 is fixed to the groove 34 by a suitable adhesive to be secured with the under surface 10 of the base 4. The grinding stones 36 each may be ones formed by binding together diamond abrasive grains by a suitable binder such as a vitrified bond. The cross sectional form of each grinding stone 36 may be rectangular. In place of the plurality of grinding stones 36 arranged at predetermined intervals in the circumferential direction, if desired, the grinding stone means 6 may be composed of an annular grinding stone continuously extending in the circumferential direction.

Figure 3:
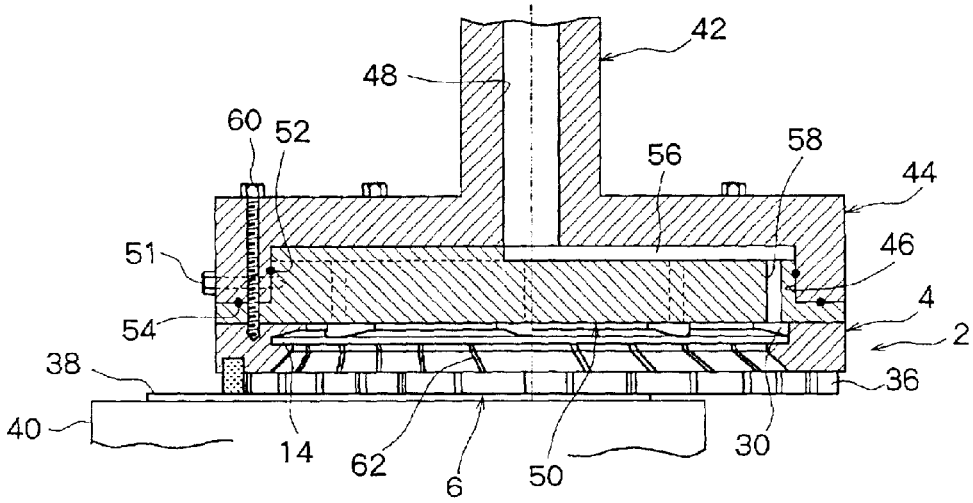
FIG. 3 is a sectional view showing how to grind one side of a semiconductor wafer by using the grinding wheel shown in FIG. 1.

FIG. 3 simply shows how to grind one side of a semiconductor wafer 38 by using the grinding wheel 2 illustrated in FIG. 1 and FIG. 2. The semiconductor wafer 38 one side of which is to be ground is held on a chuck table 40 in such a manner that one side to be ground faces up to be exposed upward. Preferably, at least a central major portion of the chuck table 40 is made of a porous material or has a large number of suction holes which has or have a structure capable of vacuum-adsorbing the semiconductor wafer 38.

A rotary shaft 42 is disposed above the chuck table 40, and the grinding wheel 2 is attached to the end of the rotary shaft 42, i.e., the lower end of the rotary shaft 42. Stated more specifically, a mounting flange 44 is formed integratedly with the lower end of the rotary shaft 42, and a circular depressed portion 46 having a relatively large diameter is formed in the under surface of the mounting flange 44. A coolant flow passage 48 which extends in a vertical direction and is open to the circular depressed portion 47 is formed in the rotary shaft 42. An additional member 50 is fixed to the lower end of the rotary shaft 42, that is, the mounting flange 44. The additional member 50 consists of an upper portion having substantially the same outer diameter as the inner diameter of the circular depressed portion 46 and a lower portion having substantially the same outer diameter as the outer diameter of the mounting flange 44, the upper portion is fitted in the circular depressed portion 46, and an annular shoulder surface defined between the upper portion and the lower portion is contacted to the under surface of the mounting flange 44. Through holes extending in the radial direction from the outer circumferential surface of the mounting flange 44 to the circular depressed portion 46 are formed in the mounting flange 44 at predetermined intervals in the circumferential direction, blind screw holes extending in the radial direction from the outer surface of the additional member 50 are formed in the upper portion of the additional member 50 at predetermined intervals in the circumferential direction, and the additional member 50 is fixed to the mounting flange 44 by screwing fastening bolts 51 into the blind screw holes of the additional member 50 through the through holes formed in the mounting flange 44. A sealing ring 52 which may be made from synthetic rubber is provided between the outer surface of the upper portion of the additional member 50 and the inner surface of the circular depressed portion 46 of the mounting flange 44, and a sealing ring 54 which may be made from synthetic rubber is also provided between the annular shoulder surface of the additional member 50 and the under surface of the mounting flange 44. A plurality of (six in the figure) grooves 56 extending radially from the center are formed in the top surface of the additional member 50 and holes 58 which extend substantially vertically from the outer ends of the grooves 56 and are open to the under surface are formed in the additional member 50. The grooves 56 and the holes 58 communicate with the coolant flow passage 48 formed in the rotary shaft 42.

Keeping describing with reference to FIGS. 1 to 3, the grinding wheel 2 is mounted to the under surface of the additional member 50. A plurality of (six in the figure) through holes extending substantially vertically are formed in the mounting flange 44 and the additional member 50 at predetermined intervals in the circumferential direction. By screwing fastening bolts 60 into the above blind screw holes 32 formed in the top surface of the base 4 of the grinding wheel 2 through the through holes, the grinding wheel 2 is mounted on the under surface of the additional member 50, that is, the lower end of the rotary shaft 42. The above respective communication notches 30 formed in the base 4 of the grinding wheel 2 are coordinated with the above respective holes 58 formed in the additional member 50. Therefore, the above coolant pool 14 formed in the base 4 of the grinding wheel 2 communicates with the coolant flow passage 48 formed in the rotary shaft 42 through the communication notches 30 formed in the base 4 and the holes 58 and the groves 56 formed in the additional member 50.

When the semiconductor wafer 38 is to be ground, the chuck table 40 is turned at a relatively low speed of 100 to 300 rpm, the rotary shaft 42 is turned at a relatively high speed of 4,000 to 5,000 rpm, and the grinding wheel 2 is pressed against one side of the semiconductor wafer 38 to grind it gradually. Thus, one side of the semiconductor wafer 38 is ground by the grinding wheel 2, more specifically by the grinding stone means 6. During grinding, the coolant which may be normal temperature pure water is supplied through the coolant flow passage 48 in the rotary shaft 42. The coolant runs from the coolant flow passage 48 of the rotary shaft 42 through the grooves 56 and the holes 58 formed in the additional member 50 and flows into the coolant pool 14 through the communication notches 30 formed in the base 4 of the grinding wheel 2. Since the grinding wheel 2 is turned at a relatively high speed, very large centrifugal force acts on the coolant, thereby making the coolant flow outward in the radial direction. However, since the coolant pool 14 which is open inward in the radial direction is formed in the grinding wheel 2 constituted according to the present invention, the coolant which tends to flow outward in the radial direction is temporarily retained in the coolant pool 14 so that it is prevented from flowing outward in the radial direction. After it is retained in the coolant pool 14, it overflows from the coolant pool 14, flows down along the lower inclined surface 28 which is inclined outward in the radial direction below the coolant pool 14 and is guided onto the grinding stone means 6 and one side of the semiconductor wafer 38 ground by the grinding stone means 6. Since the coolant which is caused to flow outward in the radial direction due to the high-speed rotation of the grinding wheel 2 is temporarily retained in the coolant pool 14 and then supplied to a required site, that is, a site where grinding is carried out, the coolant is prevented from flowing outward in the radial direction excessively and being wasted, thereby making it possible to fully make effective use of the coolant.

Figure 4:
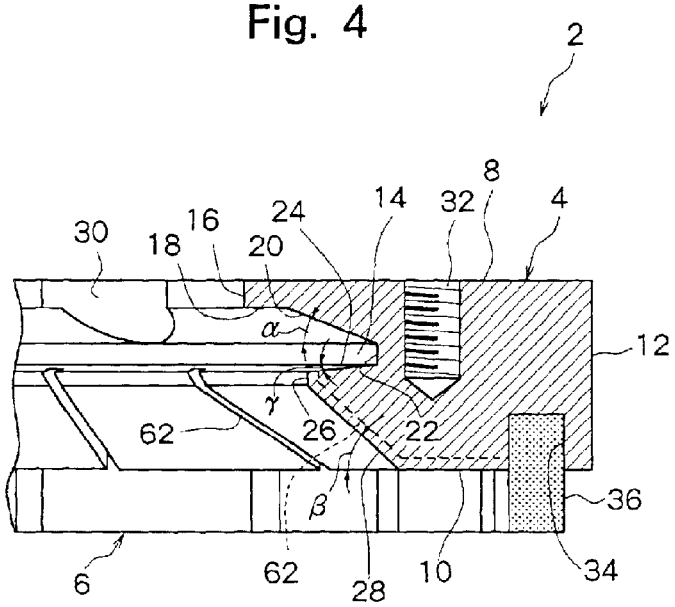
FIG. 4 is a partial sectional view of another embodiment of a grinding wheel constituted according to the present invention.
Figure 5:
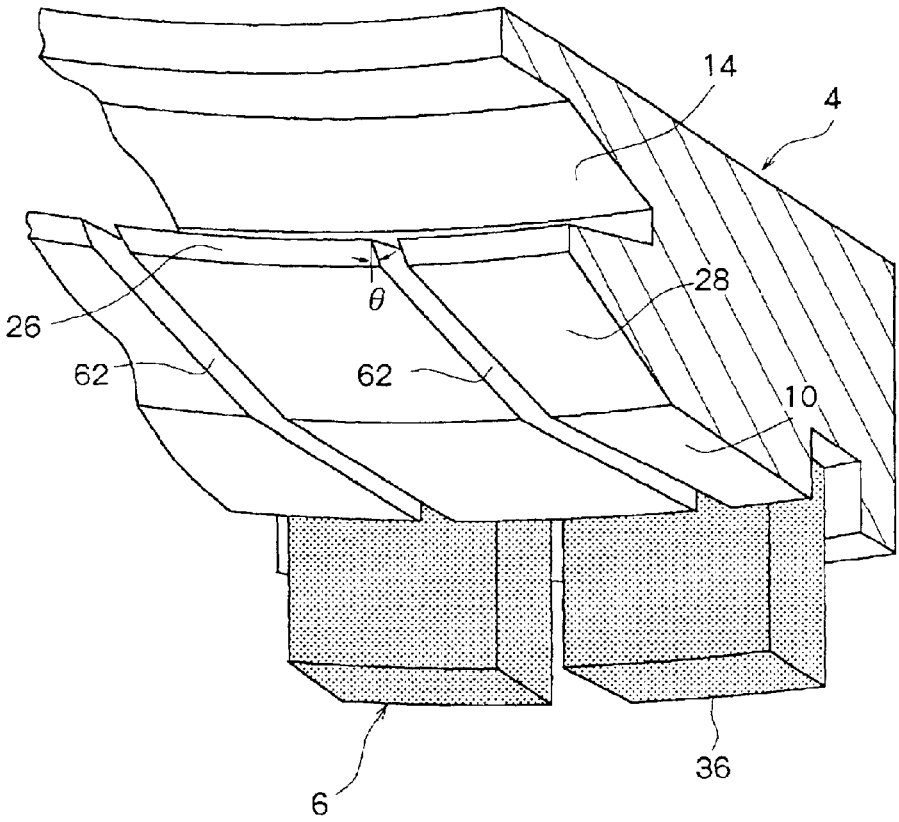
FIG. 5 is a partial perspective view of the grinding wheel shown in FIG. 4.

FIG. 4 and FIG. 5 show another embodiment of a grinding wheel constituted according to the present invention. In the embodiment shown in FIG. 4 and FIG. 5, the projecting surface 24 defining the coolant pool 14 is inclined downwardly inward in the radial direction at an angle $\gamma$ of 20° or less. A plurality of coolant guide grooves 62 which extend from the coolant pool 14 to the grinding stone means 6 are formed at predetermined intervals in the circumferential direction in the above lower vertical surface 26 and the lower inclined surface 28 of the inner surface of the base 4 and the under surface 10 of the base 4. The plurality of coolant guide grooves 62 are formed correspondingly to the plurality of grinding stones 36. Although the coolant guide grooves 62 may extend substantially vertically without being inclined in the circumferential direction, as understood with reference to FIG. 5, it is advantageous that they are inclined toward one side in the circumferential direction, that is, in the rotation direction of the grinding wheel 2 to eliminate or reduce the tendency of the coolant to flow in the circumferential direction caused by the rotation of the grinding wheel 2. Preferably, the lower end of each of the coolant guide grooves 62 extends to the inner surface of the grinding stone 36 at an upstream side of the center of the grinding stone 36 in the rotation direction of the grinding wheel 2. The inclination angle $\theta$ toward one side in the circumferential direction of the coolant guide grooves 62 may be around 20 to 60°.

In the grinding wheel shown in FIG. 4 and FIG. 5, the coolant retained in the coolant pool 14 flows out mainly through the coolant guide grooves 62 and is guided to the grinding stone means 6 and onto one side of the semiconductor wafer 38 (FIG. 3) which is being ground by the grinding stone means 6.

The grinding wheel 2 shown in FIG. 4 and FIG. 5 may be substantially identical to the grinding wheel 2 shown in FIGS. 1 to 3 except the above constitution.

EXAMPLE

The grinding wheel shown in FIG. 1 and FIG. 2 was manufactured. The base was formed from aluminum. The outer diameter D1 of the base was 290 mm, the height H1 of the base was 17 mm, the inner diameter D2 of the top surface was 158 mm, and the inner diameter D3 of the under surface was 178 mm. The height H2 of the upper vertical surface of the inner surface of the base was 2.5 mm, the width W1 of the retreating surface was 3.8 mm, the inclination angle $\alpha$ of the upper inclined surface was 20°, the length L1 of the upper inclined surface was 8.8 mm, the height H3 of the intermediate vertical surface was 1.6 mm, the width W2 of the projecting surface was 6.3 mm, the height H4 of the lower vertical surface was 1.6 mm, the inclination angle $\beta$ of the lower inclined surface was 45°, and the length L2 of the lower inclined surface was 11.3 mm. 27 Grinding stones were fixed to the under surface of the base at equal intervals in the circumferential direction. Each grinding stone had a length L3 in the circumferential direction of 20 mm, a thickness T1 of 4.0 mm and a projecting length L4 from the under surface of the base of 5.2 mm and the interval G1 in the circumferential direction between adjacent grinding stones was 2.2 mm. Each grinding stone was ones formed by binding together diamond particles having a particle diameter of 40 to 60 $\mu$m by means of a vitrified bond and the concentration of the diamond particles was 75.

The above grinding wheel was mounted to the rotary shaft of a grinder (surface grinder) marketed under the trade name of DFG841 from DISCO CORPORATION to grind one side of a semiconductor wafer having a diameter of 6 inches.

During grinding, the revolution speed of the rotary shaft was 4,800 rpm, the revolution speed of the chuck table was 200 rpm, the grinding wheel was lowered by 200 μm at a rate of 8 μm/sec and consequently, one side of the silicon wafer was ground to a depth of 200 μm. Pure water having a temperature of 24° C. was supplied as the coolant through the coolant flow passage of the rotary shaft at a rate of 3,000 cc/min.

After one-sides of 180 silicon wafers were ground, the abrasion amount (the amount of a reduction in the projecting length) of the grinding stone of the grinding wheel was measured, and was shown in Table 1 below. The grinding rate was obtained by dividing the total value of ground volumes of the silicon wafers by the total value of the worn-out volumes of the grinding stones, and was shown in Table 1 below.

COMPARATIVE EXAMPLE

Figure 6:
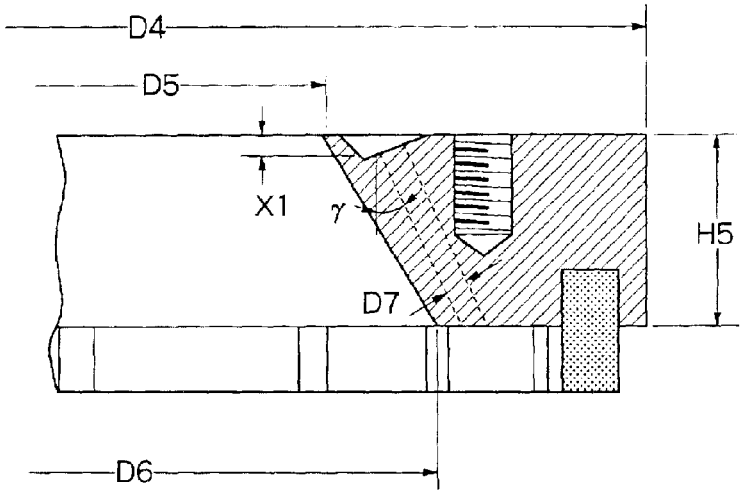
FIG. 6 is a partially enlarged sectional view of a conventional grinding wheel used in Comparative Example.

For comparison, one-sides of 180 silicon wafers were ground by using a grinding wheel identical to the grinding wheel used in Example in the same manner as in Example except for the shape of the base shown in FIG. 6. The base of the grinding wheel had an outer diameter D4 of 290 mm, a height H5 of 17 mm, an inner diameter D5 of the top surface of 138 mm, and an inner diameter D6 of the under surface of 178 mm. An annular groove which had a depth X1 of 1.9 mm and a triangular cross sectional form was formed in the inner end portion of the top surface of the base and 12 holes extending from the groove to the under surface of the base were formed in the base at equal intervals in the circumferential direction. The holes are inclined downwardly outward in the radial direction and had an inclination γ of 25° and a diameter D7 of 2 mm.

The abrasion amount (amount of a reduction in the projecting length) and grinding rate of the grinding stones of the grinding wheel were obtained in the same manner as in Example, and was shown in Table 1 below.

TABLE 1

| | abrasion amount of grinding stones (mm) | grinding rate |
|---|---|---|
| Example | 20.0 | 14950 |
| Comp. Example | 32.0 | 9344 |

Comp. Example = Comparative Example

What is claimed is:

1. A grinding wheel comprising an annular base and a grinding stone means mounted on the under surface of the base, wherein the base has inner surfaces that form a coolant pool which is open inward in a radial direction when coolant is provided into the base, and the inner surfaces include surfaces that conduct the coolant to flow radially inwardly in order to exit the pool as coolant overflows from the pool and is guided from the base to the grinding stone means.

2. The grinding wheel of claim 1, wherein the coolant pool extends continuously in a circumferential direction.

3. The grinding wheel of claim 1, wherein the coolant pool is defined between an upper inclined surface which inclines downwardly outward in the radial direction and a projecting surface which extends substantially horizontally and outward in the radial direction below the upper inclined surface.

4. The grinding wheel of claim 1, wherein a plurality of communication notches or communication holes which communicate with the coolant pool from the top surface of the base are formed at predetermined intervals in the circumferential direction.

5. The grinding wheel of claim 1, wherein the base has a lower inclined surface which inclines downwardly outward in the radial direction below a projecting surface.

6. The grinding wheel of claim 1, wherein the grinding stone means is composed of a plurality of grinding stones which extend in an arc form in the circumferential direction and are spaced apart from one another in the circumferential direction.

7. The grinding wheel of claim 1, wherein a plurality of coolant guide grooves which extend from the coolant pool to the grinding stone means are formed in the inner surface and the under surface of the base at predetermined intervals in the circumferential direction.

8. The grinding wheel of claim 7, wherein the coolant guide grooves extend from the coolant pool toward the grinding stone means and are inclined toward one side in the circumferential direction.

9. The grinding wheel of claim 7, wherein the grinding stone means is composed of a plurality of grinding stones which extend in an arc form in the circumferential direction and are spaced apart from one another in the circumferential direction, and the coolant guide grooves are formed correspondingly to the grinding stones.

10. An apparatus for use with a grinding stone means to provide a grinding wheel, said apparatus comprising:

an annular base;

means, located on an under surface of the base, for mounting a grinding stone means; and means, located at an inner surface of the base, for defining a pool for receiving coolant therein, the means defining the pool opening inwardly with respect to a radial direction of the annular base, wherein the means for defining a pool has inner surfaces that conduct the coolant to flow radially inwardly in order to exit the pool as coolant overflows from the pool and is guided to a grinding stone means.

11. A grinding wheel for use with a mounting flange and an additional member receivable within the mounting flange, the mounting flange having a coolant passage therein, the additional member having grooves and holes in communication with each other and in communication with the coolant passage when the additional member is receive within the mounting flange, said grinding wheel comprising an annular base having a top surface, inner surfaces and an under surface and grinding stone means provided at the under surface of the base, wherein the top surface of the base has notches for receiving coolant from the holes of the additional member when said grinding wheel is used with the mounting flange and the additional member, wherein the inner surfaces define a coolant pool that prevents coolant received therein from flowing radially outwardly from the pool, wherein the coolant pool is in communication with the notches to retain coolant entering the pool through the notches, and wherein the inner surfaces further guide coolant that overflows from the coolant pool to the grinding stone means.

12. The grinding wheel of claim 11, wherein the coolant pool extends continuously in a circumferential direction.

13. The grinding wheel of claim 11, wherein the coolant pool is defined between an upper inclined surface which inclines downwardly outward in the radial direction and a projecting surface which extends substantially horizontally and outward in the radial direction below the upper inclined surface.

14. The grinding wheel of claim 11, wherein the notches are located predetermined intervals in the circumferential direction in the top surface of the base.

15. The grinding wheel of claim 11, wherein the base has a lower inclined surface which inclines downwardly outward in the radial direction below a projecting surface, the lower inclined surface guiding overflow coolant radially outwardly toward the grinding stone means.

16. The grinding wheel of claim 11, wherein the grinding stone means is composed of a plurality of grinding stones which extend in an arc form in the circumferential direction and are spaced apart from one another in the circumferential direction.

17. The grinding wheel of claim 11, wherein a plurality of coolant guide grooves extend from the coolant pool to the grinding stone means and are formed in the inner surface and the under surface of the base at predetermined intervals in the circumferential direction.

18. The grinding wheel of claim 16, wherein the coolant guide grooves extend from the coolant pool toward the grinding stone means and are inclined toward one side in the circumferential direction.

19. The grinding wheel of claim 16, wherein the grinding stone means is composed of a plurality of grinding stones which extend in an arc form in the circumferential direction and are spaced apart from one another in the circumferential direction, and the coolant guide grooves are formed correspondingly to the grinding stones.

* * * * *